US007784550B2

(12) United States Patent
Nutley et al.

(10) Patent No.: US 7,784,550 B2
(45) Date of Patent: Aug. 31, 2010

(54) DOWNHOLE APPARATUS WITH A SWELLABLE CONNECTOR

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

(21) Appl. No.: 12/470,401

(22) Filed: May 21, 2009

(65) Prior Publication Data

US 2009/0272541 A1 Nov. 5, 2009

(51) Int. Cl.
*E21B 33/12* (2006.01)
*E21B 17/02* (2006.01)

(52) U.S. Cl. ..... 166/378; 166/179; 166/242.6; 166/387

(58) Field of Classification Search ..... 166/378, 166/387, 179, 242.6
See application file for complete search history.

(56) References Cited

U.S. PATENT DOCUMENTS

| | | | | |
|---|---|---|---|---|
| 4,137,970 | A * | 2/1979 | Laflin et al. | 166/292 |
| 7,431,098 | B2 * | 10/2008 | Ohmer et al. | 166/387 |
| 2006/0124310 | A1 | 6/2006 | Lopez de Cardenas et al. | |
| 2006/0175065 | A1 | 8/2006 | Ross | |
| 2007/0144733 | A1 * | 6/2007 | Murray et al. | 166/179 |
| 2009/0139707 | A1 * | 6/2009 | Berzin et al. | 166/118 |
| 2009/0179383 | A1 * | 7/2009 | Koloy et al. | 277/338 |
| 2009/0272525 | A1 * | 11/2009 | Nutley et al. | 166/241.6 |
| 2009/0277648 | A1 * | 11/2009 | Nutley et al. | 166/382 |
| 2010/0051294 | A1 * | 3/2010 | Nutley et al. | 166/387 |
| 2010/0051295 | A1 * | 3/2010 | Courville et al. | 166/387 |

FOREIGN PATENT DOCUMENTS

| | | | |
|---|---|---|---|
| GB | 2411918 | B | 11/2006 |
| GB | 2416796 | B | 2/2007 |
| WO | 0220941 | A1 | 3/2002 |
| WO | 2006121340 | A1 | 11/2006 |

OTHER PUBLICATIONS

International Written Opinion and Search Report regarding corresponding application No. PCT/GB2007/004445, dated Mar. 14, 2008.

* cited by examiner

*Primary Examiner*—Hoang Dang
(74) *Attorney, Agent, or Firm*—Wong, Cabello, Lutsch, Rutherford & Brucculeri, LLP

(57) ABSTRACT

A kit of parts which is assembled to form downhole apparatus comprises a swellable member, which expands upon contact with at least one predetermined fluid, and a connector. The swellable member has a first mating profile towards a first end and a second mating profile towards a second, opposing end. The connector has a mating profile configured to mate with each of the first and second mating profiles of the swellable member. The connector can therefore be connected to either the first and second ends of the swellable member. The connector may be an end connector, or may connect the swellable member to a second swellable member. In either case, the connector may define an arresting surface against which the swellable member abuts when expanding. The kit of parts can be adapted to and installed on any well tubular, and may form any of a variety of tools.

24 Claims, 12 Drawing Sheets

DOWNHOLE APPARATUS WITH A SWELLABLE CONNECTOR

CROSS-REFERENCE TO RELATED APPLICATIONS

This application claims priority to PCT application WO 2008/062178 A1 PCT/GB2007/004445, filed Nov. 21, 2007, which in turn claims priority to United Kingdom Patent Application No. GB0623138.5, filed on Nov. 21, 2006.

FIELD OF THE INVENTION

The present invention relates to a kit of parts and a method of forming the same which, when assembled, forms downhole apparatus configured to be disposed on a tubular in a downhole environment.

BACKGROUND

A well packer provides a seal in an annulus formed between an exterior surface of a tubular and an interior surface of well casing or a wellbore. Known forms of well packers are introduced to the downhole environment in which they are to be used in an unexpanded condition and expanded in-situ to provide the desired seal. In one form, the well packer expands upon coming into contact with a well fluid. In another form, the well packer comprises movable parts that are actuated in-situ to form the seal. The present inventor has appreciated that conventional packers have shortcomings and the present invention has been devised in the light of this appreciation.

SUMMARY

According to a first aspect of the present invention, there is provided a kit of parts which, when assembled together, forms downhole apparatus configured to be disposed on a tubular in a downhole environment, the kit of parts comprising: a swellable member which expands upon contact with at least one predetermined fluid, the swellable member having a first mating profile towards a first end and a second mating profile towards a second, opposing end; and a connector having a mating profile configured to mate with each of the first and second mating profiles of the swellable member such that the connector can be connected to either of the first and second ends of the swellable member.

Known well packers and similar such apparatus, such as centralisers and anchors, are normally provided configured ready for use according to specification. Such well packers typically comprise many sub-components of complex form. Thus, assembling a well packer to meet one of a number of specifications can necessitate the keeping a large stock of differently configured sub-components and lengthy and thus expensive assembly procedures. The present invention addresses these problems by providing a kit of parts that can be assembled in the field to meet a particular specification. For example, a series of kits of parts according to the invention can be connected together to provide a string of swellable members where packer coverage of a long length of tubular is required.

Known well packers and similar such apparatus are normally ordered from a supplier some time in advance of the date for bringing the apparatus into use. Thus, decisions as regards downhole operations, e.g. specific isolation operations, can be subject to a lesser or greater extent to the performance of the apparatus when delivered. This is because known apparatus can be rarely modified on site. The present invention can address such problems by providing for an improvement in flexibility of approach. For example, the configuration of a string of downhole apparatus formed from a plurality of kits of parts according to the invention can be changed on site and more immediately before use in the downhole environment.

More specifically, the first and second mating profiles may have substantially the same shape. Alternatively or in addition, the swellable member may swell upon contact with at least one of: a fluid comprising an aqueous solution; and a polar liquid, e.g., oil.

Alternatively or in addition, the connector may have first and second mating profiles, each of the first and second mating profiles of the connector being configured to mate with each of the first and second mating profiles of the swellable member. Thus in use, the first mating profile of the connector may be mated with either the first mating profile or the second mating profile of the swellable member. Alternatively, the second mating profile of the connector may be mated with either the first mating profile or the second mating profile of the swellable member. Furthermore, a plurality of kits of parts according to the present invention can be used to connect a plurality of swellable members together, e.g. to provide a greater length of downhole apparatus.

More specifically, the first mating profile of the connector may be disposed towards a first end of the connector and the second mating profile may be disposed towards a second, opposing end of the connector. Alternatively or in addition, the first and second mating profiles of the connector may have substantially the same shape. Alternatively or in addition, the first and second mating profiles of the connector may be in line with each other such that, in use, two swellable members connected by means of the connector are in line with each other.

Alternatively, the first and second mating profiles may be oriented such that, in use, two swellable members connected by means of the connector are out of line with each other. More specifically, the first and second mating profiles may be oriented such that, in use, two swellable members connected by means of the connector are disposed at about ninety degrees to each other. Thus, such a connector defines a right angled corner in a string comprising two swellable members connected by means of the connector.

Alternatively or in addition, a mating profile of the connector may comprise a plurality of ridges extending away from an end of the connector. Alternatively or in addition, a mating profile of the swellable member may comprise a plurality of ridges extending away from an end of the swellable member. More specifically, the mating profiles of the connector and the swellable member may be configured for a push fit connection of the connector and the swellable member with each other.

Alternative or in addition, the connector and the swellable member may be connected to each by means of an adhesive. Alternatively or in addition, a mating profile of the connector may comprise a threaded profile. Alternatively or in addition, a mating profile of the swellable member may comprise a threaded profile. Alternatively or in addition, the swellable member may define a mating recess, the mating profile being defined on a surface of the mating recess. Thus, a mating profile of the connector may be received in the mating recess such that the respective mating profiles of the expanding member and the connector mate.

Alternatively or in addition, the kit of parts may be configured such that a mating profile of one of the connector and the swellable member may upon mating be received in a mating profile of the other of the connector and the swellable member. Alternatively or in addition, the swellable member may be of elongate form. Alternatively or in addition, the swellable member may define a bore extending therethrough. Thus, the swellable member may be fitted around a tubular. More specifically, the swellable member may have a substantially cylindrical shape.

Alternatively, a cross sectional profile of the swellable member may vary along the swellable member. For example, a diameter of an external surface of the swellable member may change along the swellable member.

Alternatively or in addition, the swellable member may be configured such that a surface of the swellable member defines at least one irregularity. The at least one irregularity may increase a surface area of the swellable member that may come into contact with the at least one predetermined fluid compared with a swellable member defining an even surface. Thus, a rate of expansion of the swellable member may be increased. More specifically, the at least one irregularity may comprise at least one of: a groove, a ridge, an indentation, a protuberance, a roughened area and an aperture to a bore, which extends into the swellable member. Where the at least one irregularity is an aperture to a bore, the bore may connect one surface of the swellable member to another surface of the swellable member. Thus, the at least one predetermined fluid may pass though the swellable member by way of the at least one bore from one surface to the other surface. Alternatively or in addition, the at least one irregularity may extend substantially longitudinally along the swellable member. For example, where the irregularity is a channel the channel may extend longitudinally along the swellable member. Alternatively or in addition, the at least one irregularity may extend around the swellable member. For example, where the irregularity is a channel and the swellable member is of a substantially cylindrical form, the channel may extend circumferentially around the swellable member.

Alternatively or in addition, the swellable member may comprise a layer disposed over at least a part of an exterior surface of the swellable member, the layer being configured to control access of the at least one predetermined fluid to the exterior surface of the swellable member. Thus, the layer may control how the swellable member expands when brought into contact with the at least one predetermined fluid. More specifically, the layer may be configured to present a barrier to the at least one predetermined fluid for a predetermined period of time. Thus, the layer can function as a temporary barrier. Alternatively or in addition, the layer may be configured to provide for the at least one predetermined fluid to pass through the layer at a predetermined rate. Thus, the layer can be used to reduced a rate at which the swellable member expands when in the presence of the at least one predetermined fluid than would be the case were the layer to be absent.

Alternatively or in addition, the kit of parts may further comprise a reinforcing arrangement configured to be disposed on a surface of the swellable member to be presented to the tubular.

Alternatively or in addition, the swellable member may comprise a reinforcing arrangement. More specifically, the reinforcing arrangement may be embedded in the swellable member. The reinforcing arrangement may comprise at least one of: a metal, a plastics, a composite and individual composite materials, such as carbon-fibre or Kevlar®.

Alternatively or in addition, the swellable member may be of elongate form. Alternatively or in addition, the swellable member may have a length of between about 30.48 cm (1 foot) and about 91.44 cm (3 feet).

Alternatively or in addition, the swellable member may comprise ethylene-propylene co-polymer cross-linked with at least one of a peroxide and sulphur. Thus, the swellable member may expand upon contact with a polar liquid, such as oil. More specifically, the swellable member may comprise ethylene propylene diene monomer rubber (EPDM). Alternatively or in addition, the swellable member may comprise at least one of an amide-base cross-linked resin and a water swellable urethane. Thus, the swellable member may expand upon contact with water. More specifically, the swellable member may comprise at least one of chloroprene, styrene butadiene and ethylene-propylene rubber. Alternatively or in addition, the swellable member may comprise an N-vinylcarboxylic acid amide-base cross-linked resin. Alternatively or in addition, the swellable member may expand upon contact with at least one fluid to be found in a downhole environment.

Alternatively or in addition, the connector may define a bore extending therethrough. Thus, when the connector and the swellable member are connected together they may be fitted around a tubular. More specifically, the connector may have a generally cylindrical shape.

Alternatively or in addition, the connector may comprise an arresting member configured to arrest expansion of the swellable member in a predetermined direction when the kit of parts is assembled and in use. Thus, the arresting member can constrain expansion of the swellable member such that the swellable member expands primarily in a desired direction, for example, away from the tubular on which the downhole apparatus is disposed. More specifically, the arresting member may define an arresting surface against which the swellable member abuts when expanding. More specifically, the arresting member may extend in a direction substantially away from a tubular on which the downhole apparatus is configured to be disposed and the arresting surface may face an end of the swellable member. Alternatively or in addition, the arresting member may extend in a direction substantially towards a tubular on which the downhole apparatus is configured to be disposed and the arresting surface may face an end of the swellable member.

Alternatively or in addition, the arresting member may comprise at least one flange. One flange may extend in a direction substantially away from a tubular which the downhole apparatus is configured to be disposed and another flange may extend in a direction substantially towards the tubular. More specifically, where the connector defines a bore, the bore may extend longitudinally through the connector and the flange may extend radially of the connector.

Alternatively or in addition, the connector may be formed in part of at least one of: a metal, such as steel, a plastics material, such as nylon, or a composite, such as carbon-fibre reinforced plastics.

In a first form, the kit of parts may further comprise a second swellable member. More specifically, the second swellable member may have a first mating profile towards a first opposing end and a second mating profile towards a second, opposing end. The first and second mating profiles of the second swellable member may be configured to mate with a mating profile of the connector. More specifically, the kit of parts may further comprise at least one further connector having features as described above with reference to the connector and at least one further expanding member having features described above with reference to the expanding member.

In a second form, the kit of parts may comprise an end connector configured to mate with a mating profile of the expanding member. More specifically, the end connector may be formed at least in part of at least one of: a metal, such as steel, a plastics material, such as nylon, or a composite, such as carbon-fibre reinforced plastics.

Alternatively or in addition, the end connector may have a mating profile configured to mate with each of the first and second mating profiles of the swellable member. Thus, for example, the end connector may be used to terminate a string of swellable members on a tubular formed from a plurality of kits of parts according to the present invention. More specifically, the mating profile of the end connector may comprise a threaded profile.

Alternatively or in addition, the end connector may have a chamfered end. More specifically, the chamfered end and the mating profile may be towards opposing ends of the end connector.

Alternatively or in addition, the end connector and the swellable member may be connected to each other by means of an adhesive.

Alternatively or in addition, the end connector may be of elongate form. Alternatively or in addition, the end connector may define a bore extending therethrough. Thus, the end connector may be fitted around a tubular.

Alternatively or in addition, the end connector may comprise a first end connector assembly configured to mate with a mating profile of the expanding member and a second end connector assembly configured to be releasably attached to a tubular, the first and second end connector assembly being configured to be releasably attached to each other. More specifically, end connector may be configured such that releasably connecting the second end connector assembly to the tubular provides for releasable attachment of the first and second end connector assemblies to each other. Alternatively or in addition, the second end connector assembly may comprise two end connector parts movable in relation to each other between a first disposition that provides for removal of the second end connector assembly from the tubular and a second disposition in which the second end connector assembly is attached to the tubular. More specifically, the two end connector parts may be movable between the first and second dispositions by hinged movement of the two end connector parts in relation to each other. Thus, the two end connector parts may clamp around the tubular. Alternatively or in addition, the two end connector parts may be maintained in the second disposition by securing respective portions of the two end connector parts to each other. More specifically, the respective portions of the two end connector parts may be secured to each other by means of at least one of: adhesive, at least one screw, at least one nut and bolt, and the like.

Alternatively or in addition, the second end connector assembly may be shaped to provide for passage of at least one elongate body, such as a wire or small diameter pipe, along the tubular to which the second end connector assembly is attached such that the at least one elongate body passes between the second end connector assembly and the tubular. Alternatively or in addition, the second end connector assembly may be configured to clamp around the first end connector assembly when in the second disposition.

Alternatively or in addition, the first and second end connector assemblies may have surface profiles shaped to resist separation of the first and second end connector assemblies from each other when in the second disposition.

Alternatively or in addition, the end connector may be configured to resist movement of the second end connector assembly in relation to a tubular when the second end connector assembly is attached to the tubular. More specifically, the end connector may have an anti-slip surface configured to resist movement across an exterior surface of the tubular. More specifically, the anti-slip surface may define a plurality of irregularities, such as circumferentially extending ridges, configured to bite into the exterior surface.

Alternatively or in addition, the end connector may further comprise an anti-slip assembly, which is configured to provide resistance to movement of the second end connector assembly in relation to the tubular. More specifically, the end connector may be configured such that, in use, the anti-slip assembly is disposed between the second end connector assembly and the tubular.

Alternatively or in addition, the end connector may be configured to resist separation of the anti-slip assembly and the second end connector assembly from each other. More specifically, the anti-slip assembly and the second end connector assembly may have inter-engaging profiles. More specifically, the end connector may have a substantially cylindrical shape.

Alternatively or in addition, the end connector may comprise a bore member configured to change a diameter of the bore. More specifically, the end connector may be configured to provide for a gradual change in the diameter of the bore.

Alternatively or in addition, the end connector may be configured such that movement of the bore member in relation to a main body of the end connector provides for the change in diameter. More specifically, the bore member and the main body of the end connector may be moved in a longitudinal direction in relation to each other.

Alternatively or in addition, the bore member may have a tapering portion that movably engages with a main body of the end connector to provide for a change in diameter.

Alternatively or in addition, the end connector may comprise an end arresting member configured to arrest expansion of the swellable member in a predetermined direction when the kit of parts is assembled and in use. Thus, the end arresting member can constrain expansion of the swellable member such that the swellable member expands primarily in a desired direction, for example, away from a tubular on which the downhole apparatus is disposed. More specifically, the end arresting member may define an arresting surface against which the swellable member abuts when expanding. More specifically, the end arresting member may extend in a direction substantially away from a tubular on which the downhole apparatus is configured to be disposed and the arresting surface may face an end of the swellable member.

Alternatively or in addition, the end arresting member may extend in a direction substantially towards a tubular on which the downhole apparatus is configured to be disposed and the arresting surface may face an end of the swellable member.

Alternatively or in addition, the arresting member may comprise at least one lip. A lip may extend in a direction substantially away from a tubular on which the downhole apparatus is configured to be disposed and another lip may extend in a direction substantially towards the tubular.

Alternatively or in addition, the end connector may comprise at least one tubular connector configured for providing, at least in part, a connection to a tubular on which the downhole apparatus is disposed when in use. More specifically, the end connector may comprise a plurality of tubular connectors spaced apart on the end connector. More specifically, the plurality of tubular connectors may be spaced apart around the end connector.

Alternatively or in addition, the at least one tubular connector may comprise a fastener configured to be connected to a tubular. More specifically, the fastener may comprise a bolt that threadedly engages with a corresponding threaded profile formed in the end connector.

In a third form, the kit of parts may further comprise a support apparatus configured to abut against a surface of the swellable member before and during expansion of the swellable member, the surface against which the supporting apparatus abuts being presented, in use, towards the tubular. More specifically, the support apparatus may be configured to abut against a portion of the surface of the swellable member. More specifically, the support apparatus may extend along a part of a length of the swellable member.

Alternatively or in addition, the support apparatus may comprise a plurality of rigid support members that are configured for movement in relation to each other to accommodate expansion of the swellable member. More specifically, where the swellable member is of cylindrical form and defines a longitudinally extending bore, the plurality of rigid support members may be moveable in a radial direction.

Alternatively or in addition, the downhole apparatus further comprises a rigid assembly, the downhole apparatus having a first condition before expansion of the swellable member, in which the rigid assembly defines a maximum outer diameter of the downhole apparatus, and a second condition after expansion of the swellable, in which the swellable member defines a maximum outer diameter of the downhole apparatus. More specifically, the downhole apparatus may be configured such that a part of the rigid assembly is surrounded by the swellable member. More specifically, the rigid assembly may comprise at least one collar surrounded by the swellable member. More specifically, the at least one collar may be proximal to a bore defined by the swellable member and extending through the downhole apparatus.

Alternatively or in addition, rigid assembly may comprise two collars spaced apart from each other in a longitudinal direction on the downhole apparatus. Alternatively or in addition, the rigid assembly may comprise a plurality of spaced apart fingers. More specifically, each of the plurality of spaced apart fingers may extend in a longitudinal direction. Alternatively or in addition, the fingers may be spaced apart radially around the downhole apparatus. Alternatively or in addition, the plurality of fingers may be attached to a collar towards each opposing end of the downhole apparatus. Alternatively or in addition, the at least one collar and the plurality of fingers may be integrally formed with each other.

Alternatively or in addition, the rigid assembly may be formed at least in part of at least one of: a metal, a composite, a rigid plastics, and the like. Alternatively or in addition, the swellable member may be attached to the tubular, e.g., by means of an adhesive.

According to a second aspect of the present invention, there is provided a kit of parts according to the first aspect of the present invention which, when assembled together, forms downhole apparatus configured to provide a seal between the tubular and another wellbore component. Thus, the present invention may be used to isolate a part of a well. Seals are often used in downhole environments to contain and/or control well fluids. Such well fluids may be flowing to or from a subterranean geological formation or may be flowing to or from the surface. Isolation can be used to control the flow of well fluids or prevent undesired mixing of different well fluids. More specifically, the other wellbore component may be one of: a casing and an inside surface of a wellbore. Further embodiments of the second aspect of the present invention may comprise one or more features of the first aspect of the present invention.

According to a third aspect of the present invention, there is provided a kit of parts according to the first aspect of the present invention which, when assembled together, forms downhole apparatus configured to provide stand-off between a tubular and a wellbore surface. Thus, the present invention may take the form of a centraliser when assembled. In use, centralisers perform important functions in downhole environments. Centralisers may, for example, ensure that a tubular does not come into contact with a wellbore surface. This function is of particular importance when a tubular is being cemented into a wellbore. This is because a poorly centralised tubular can lead to channelling, i.e. the failure to form a cement bond around the entire circumference of the annular space between the tubular and the wellbore. This results in poor isolation of well fluids, which can ultimately lead to uncontrollable flow of well fluids to the surface or to subterranean geological formations. Further embodiments of the third aspect of the present invention may comprise one or more features of the first aspect of the present invention.

According to a fourth aspect of the present invention, there is provided a kit of parts according to the first aspect of the present invention which, when assembled together, forms downhole apparatus configured to limit movement of a tubular in relation to a wellbore surface. Tubular anchors are employed in downhole environments to limit movement of a tubular in relation to a wellbore. Movement of a tubular can be caused by mechanical loading of the tubular or hydraulic piston forces. In addition, a temperature change across a well can cause expansion or contraction of a tubular and thereby cause movement of the tubular in relation to the well. Further embodiments of the fourth aspect of the present invention may comprise one or more features of the first aspect of the present invention.

According to a fifth aspect of the present invention, there is provided oil or gas recovery or exploration apparatus comprising downhole apparatus assembled from the kit of parts according to the first aspect of the present invention. Further embodiments of the fifth aspect of the present invention may comprise one or more features of the first aspect of the present invention.

According to a sixth aspect of the present invention, there is provided a method of assembling downhole apparatus, the method comprising connecting a connector to a swellable member to form the downhole apparatus by mating a mating profile of the connector with one of first and second mating profiles of the swellable member, the mating profile of the connector being configured to mate with each of the first and second mating profiles, the first mating profile being towards a first end of the connector and the second mating profile being towards a second, opposing end of the connector, the swellable member expanding upon contact with at least one predetermined fluid, and the thus formed downhole apparatus being configured to be disposed on a tubular in a downhole environment. Further embodiments of the sixth aspect of the present invention may comprise one or more features of the first aspect of the present invention.

According to a further aspect of the present invention, there is provided downhole apparatus configured to be disposed on a tubular in a downhole environment, the downhole apparatus comprising a swellable member which expands upon contact with at least one predetermined fluid, in which the swellable member is configured such that a surface of the swellable member defines at least one irregularity. In use, the at least one irregularity increases a surface area of the swellable member that comes into contact with the at least one predetermined fluid compared with a swellable member defining an even surface, e.g. a swellable member of substantially cylindrical form having an even surface. Thus, a rate of expansion of the swellable member may be increased. More specifically, the at least one irregularity may comprise at least one of: a groove, a ridge, an indentation, a protuberance, a roughened area and an aperture to a bore, which extend into the swellable member. Where the at least one irregularity is an aperture to a bore, the bore may connect one surface of the swellable member to another surface of the swellable member. Thus, the at least one predetermined fluid may pass though the swellable member by way of the at least one bore from one surface to the other surface. Alternatively or in addition, the at least one irregularity may extend substantially longitudinally along the swellable member. For example, where the irregularity is a channel the channel may extend longitudinally along the swellable member. Alternatively or in addition, the at least one irregularity may extend around the swellable member. For example, where the irregularity is a channel and the swellable member is of a substantially cylindrical form, the channel may extend circumferentially around the swellable member. Alternatively or in addition, the swellable member may form part of a kit of parts which, when assembled together forms the downhole apparatus. More specifically, the swellable member may have a first mating profile towards a first end and a second mating profile towards a second, opposing end, and the kit of parts may further comprise a connector having a mating profile configured to mate with each of the first and second mating profiles of the swellable member such that the connector can be connected to either of the first and second ends of the swellable member. Further embodiments of the further aspect of the present invention may comprise one or more features according to any preceding aspect of the present invention.

According to a yet further aspect of the present invention, there is provided downhole apparatus configured to be disposed on a tubular in a downhole environment, the downhole apparatus comprising: a swellable member which expands upon contact with at least one predetermined fluid; and a rigid assembly, the downhole apparatus having a first condition before expansion of the swellable member, in which the rigid assembly defines a maximum outer diameter of the downhole apparatus, and a second condition after expansion of the swellable, in which the swellable member defines a maximum outer diameter of the downhole apparatus. When the downhole assembly is in use downhole in the first condition the rigid assembly can provide stand-off protection. When the downhole assembly is in the second condition, the swellable member is expanded to, for example, provide isolation. More specifically, the downhole apparatus may be configured such that a part of the rigid assembly is surrounded by the swellable member. More specifically, the rigid assembly may comprise at least one collar surrounded by the swellable member. More specifically, the at least one collar may be proximal to a bore defined by the swellable member and extending through the downhole apparatus. Alternatively or in addition, rigid assembly may comprise two collars spaced apart from each other in a longitudinal direction on the downhole apparatus. Alternatively or in addition, the rigid assembly may comprise a plurality of spaced apart fingers. More specifically, each of the plurality of spaced apart fingers may extend in a longitudinal direction. Alternatively or in addition, the fingers may be spaced apart radially around the downhole apparatus. Alternatively or in addition, the plurality of fingers may be attached to a collar towards each opposing end of the downhole apparatus. Alternatively or in addition, the at least one collar and the plurality of fingers may be integrally formed with each other. Alternatively or in addition, the rigid assembly may be formed at least in part of at least one of: a metal, a composite, a rigid plastic, and the like. Further embodiments of the yet further aspect of the present invention may comprise one or more features according to any preceding aspect of the present invention.

DETAILED DESCRIPTION

Figure 1:
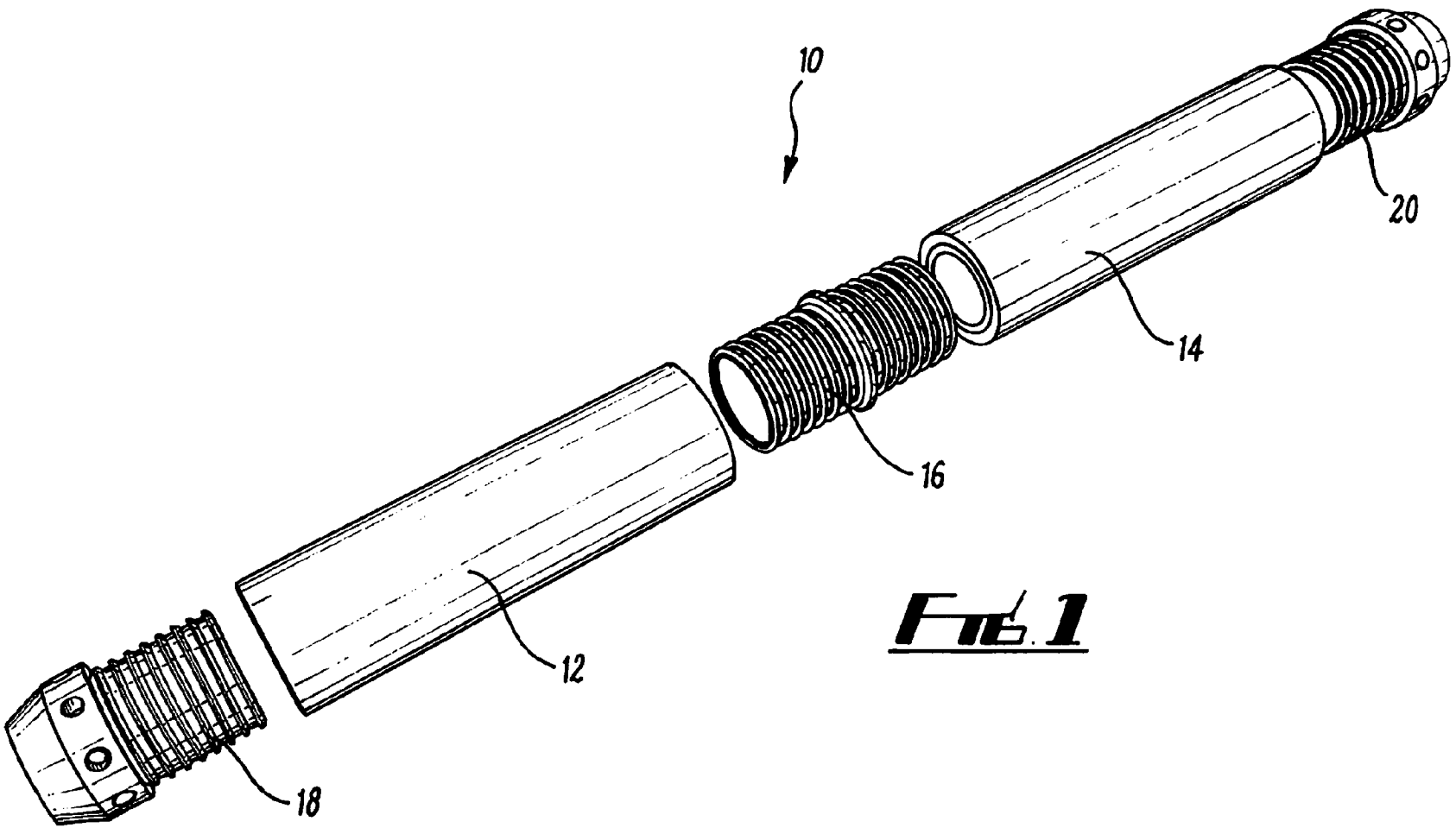
FIG. 1 shows a kit of parts according to an embodiment of the present invention.

FIG. 1 shows a kit of parts 10 according to the present invention having a first swellable member 12, a second swellable member 14, a connector 16, a first end connector 18 and a second end connector 20. The connector 16 is configured to connect the two swellable members 12, 14 together as described below. The first and second end connectors 18, 20 connect to opposing ends of the connected swellable members 12, 14 as described below. Each of the first and second swellable members 12, 14, the first and second end connectors 18, 20 and the connector 16 are of generally cylindrical form and thus define a bore extending longitudinally therethrough.

Figure 2:
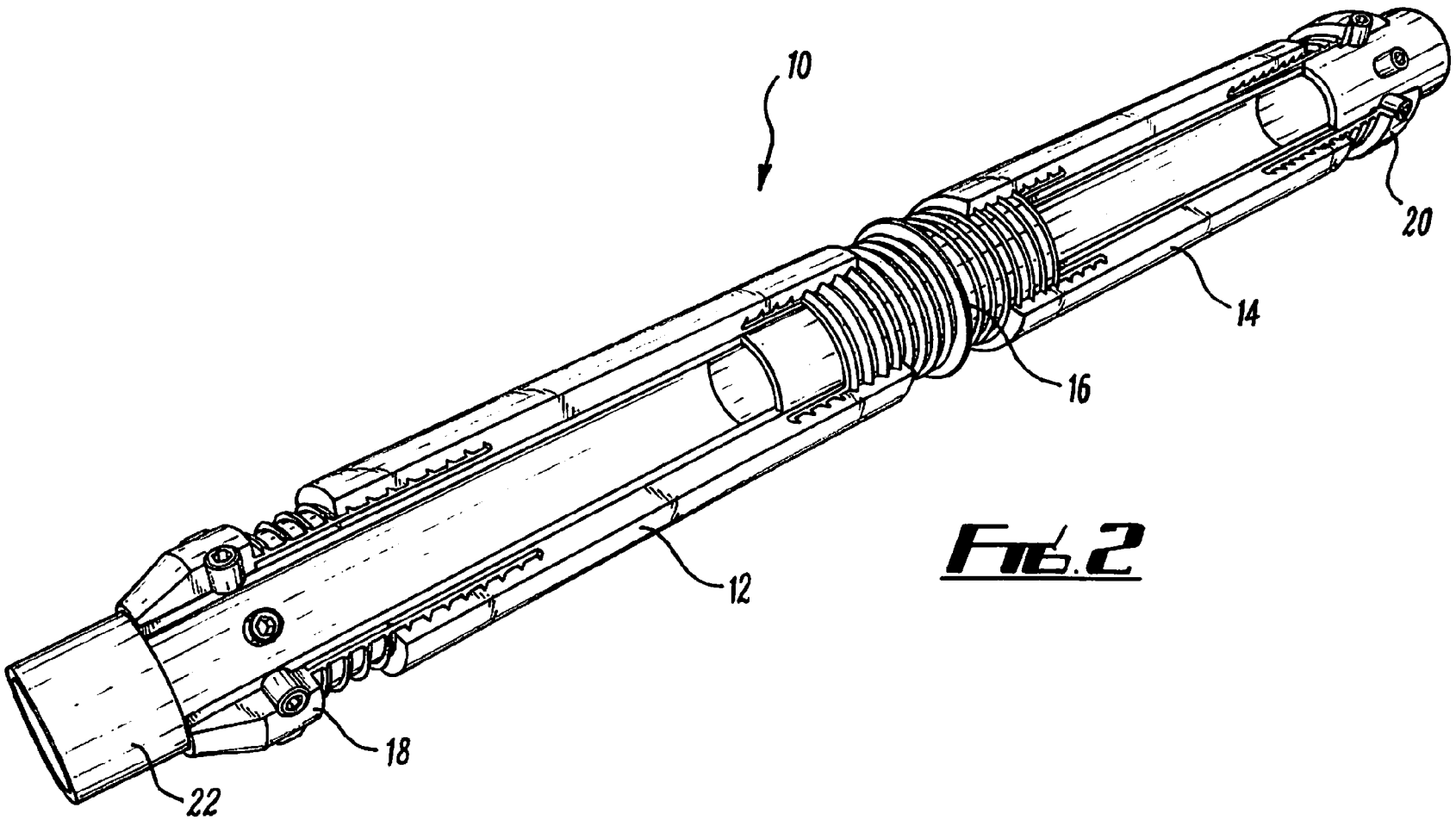
FIG. 2 shows the kit of parts of FIG. 1 partially installed on a tubular.

The kit of parts 10 of FIG. 1 is assembled together and fitted onto a tubular 22, such as a standard oilfield American Petroleum Institute (API) tubular, as shown in part assembled form in FIG. 2. The first and second swellable members 12, 14 each have a ridged profile at each end. The connector 16 also has a ridged profile at each end. The ridged profile at a first end of the connector 16 is pushed into the ridged profile at one end of the first swellable member 12 and the ridged profile at the second, opposing end of the connector is pushed into the ridged at one end of the second swellable member 14. Thus, the first and second swellable members 12, 14 are connected to each other end to end by the connector 16. Each of the end connectors 18, 20 has a ridged profile, which is pushed onto a respective ridged profile at a free end of the connected swellable members 12, 14. The thus joined swellable members, connector and end connectors together define a bore through which the tubular 22 extends.

Figure 3:
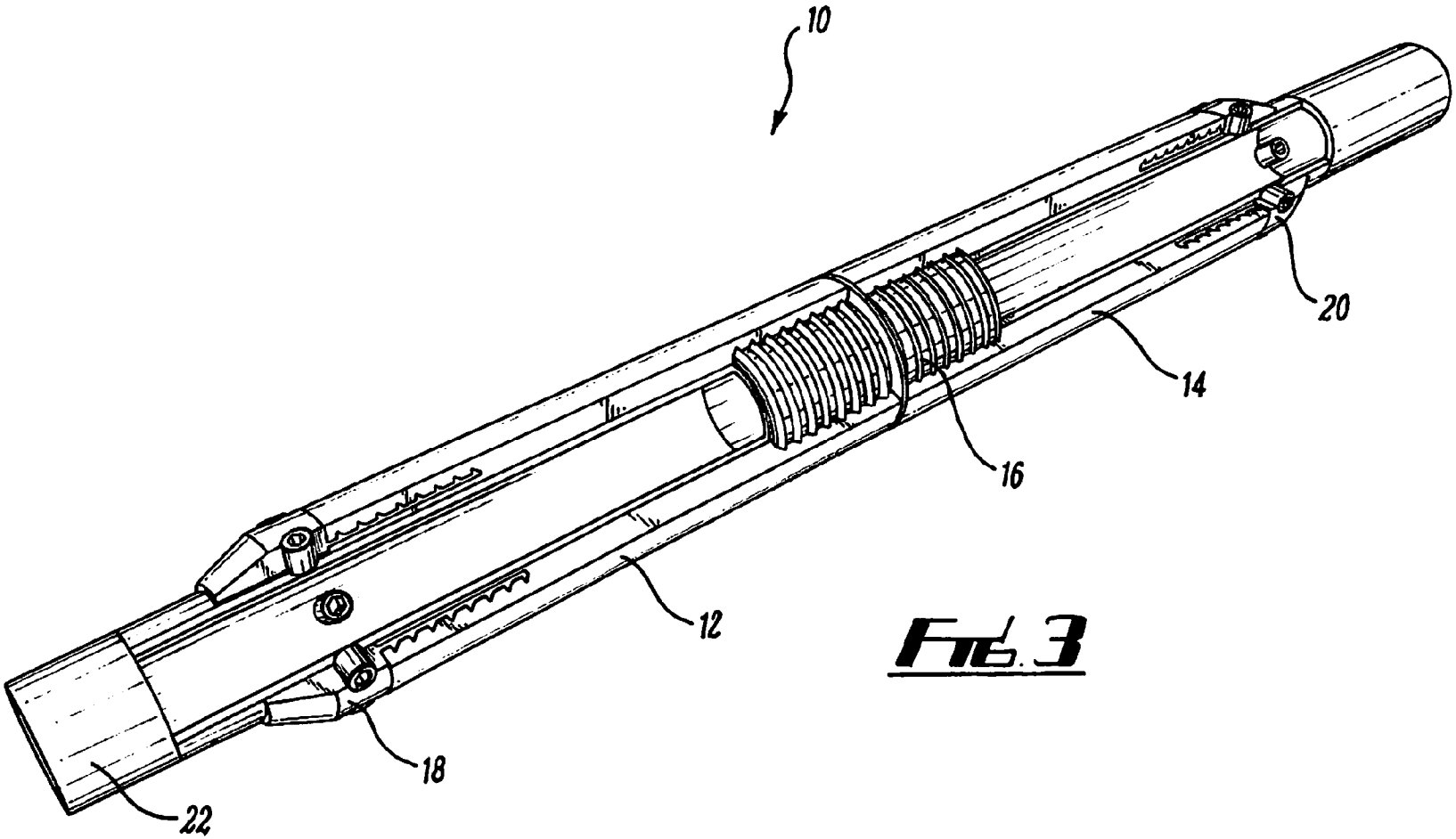
FIG. 3 shows the kit of parts of FIG. 1 installed on a tubular.

FIG. 3 shows the kit of parts 10 installed on the tubular 22 of FIG. 2. More specifically, the ridged profiles of the end connectors 18, 20 and the connector 16 are fully received in the ridged profiles of the swellable members 12, 14 such that these components are properly connected to each other.

Figure 4:
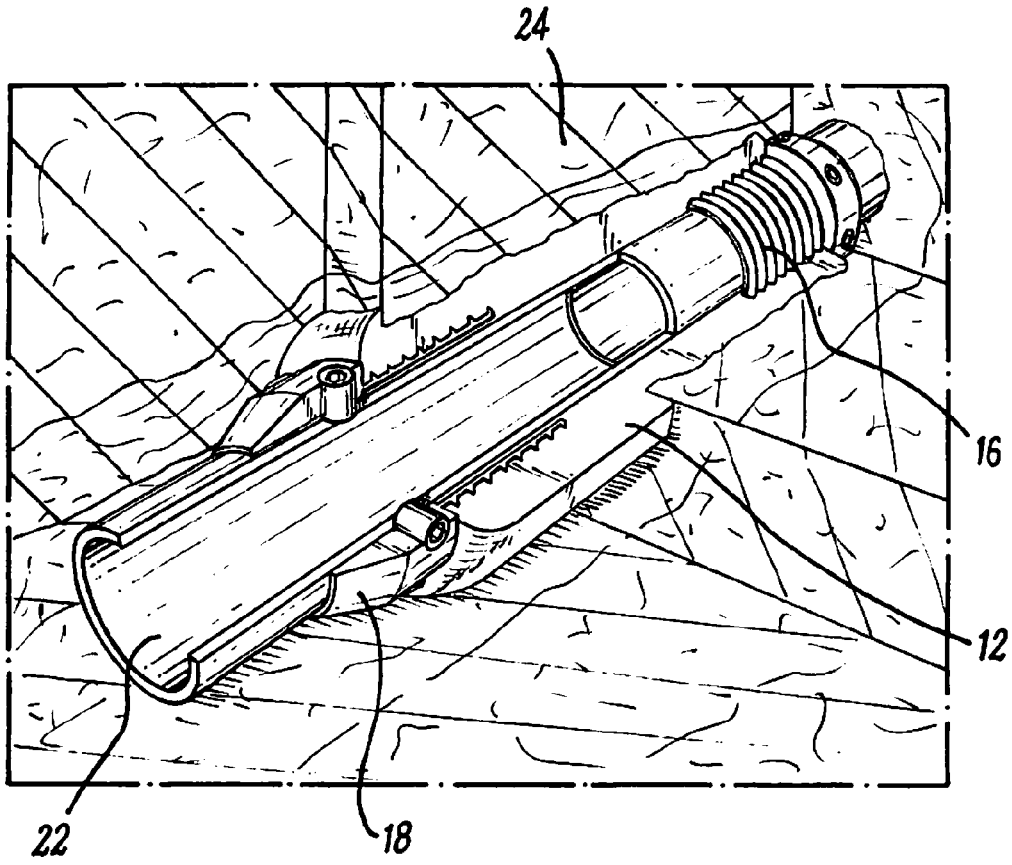
FIG. 4 shows the kit of parts of FIG. 1 assembled and in situ in a downhole environment.

FIG. 4 shows a kit of parts comprising a swellable member 12, a connector 16 and an end connector 18 connected together in series, as described above, and fitted on a tubular 22, which extends through a subterranean geological formation 24.

Figure 5:
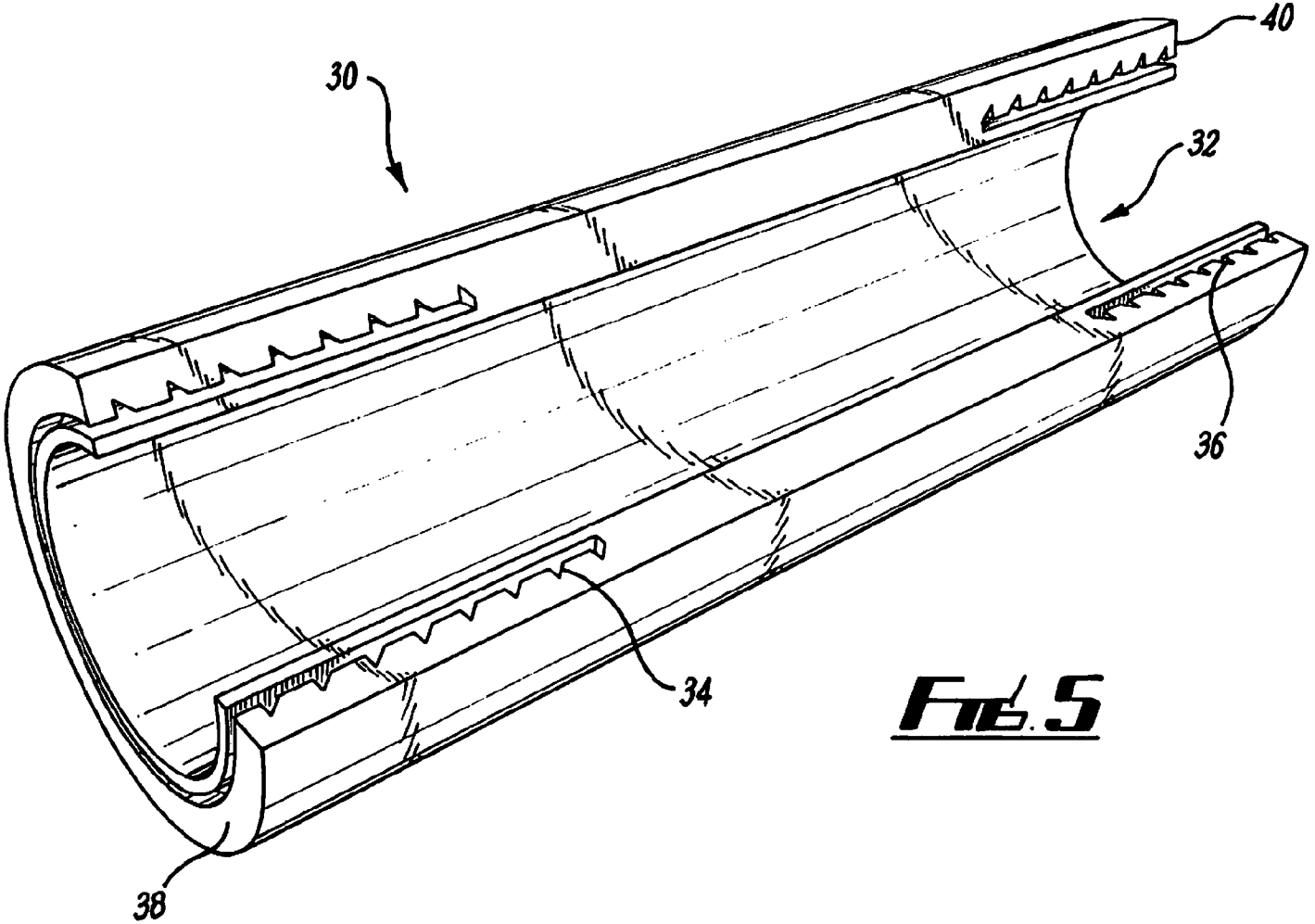
FIG. 5 provides a detailed view of a swellable member of the kit of parts of FIG. 1.

FIG. 5 provides a detailed view 30 of the swellable member of FIGS. 1 to 4. The swellable member 30 of FIG. 5 is of substantially cylindrical shape and thus defines a bore 32. The length of the swellable member is between about 30.48 cm (1 foot) and about 91.44 cm (3 feet). The internal and external diameters of the swellable member are determined for the application in mind. Indeed, the kit of parts may comprise a number of such swellable members each having different internal and external diameters and different swellable elastomers so that selective use can be made of the kit of parts depending on the application in mind. Returning to FIG. 5, the swellable member has a ridged profile 34, 36, as described above, at each opposing end 38, 40 of the swellable member. Each ridged profile 34, 36 is defined in a recess formed in an end of the swellable member such that when, for example, a connector 16 is connected to the swellable member 30, the ridged profile of the connector is sandwiched between portions of the swellable member.

The swellable member 30 is formed of a swellable elastomer. The swellable member 30 may also have a reinforcing member such as KEVLAR® (not shown), which is embedded in and extends along the swellable member. A swellable elastomer is an elastic material that swells when placed in certain fluids. Swelling is caused by the absorption of fluid. There are two main types of swellable elastomers: those that swell in oil; and those that swelling in an aqueous solution.

Where the swellable member swells in oil, the member may comprise ethylene propylene diene monomer rubber (EPDM). Where the swellable member swells in water, the member may comprise an N-vinylcarboxylic acid amide-base cross-linked resin and a water swellable urethane in an ethylene-propylene rubber matrix.

Figure 6:
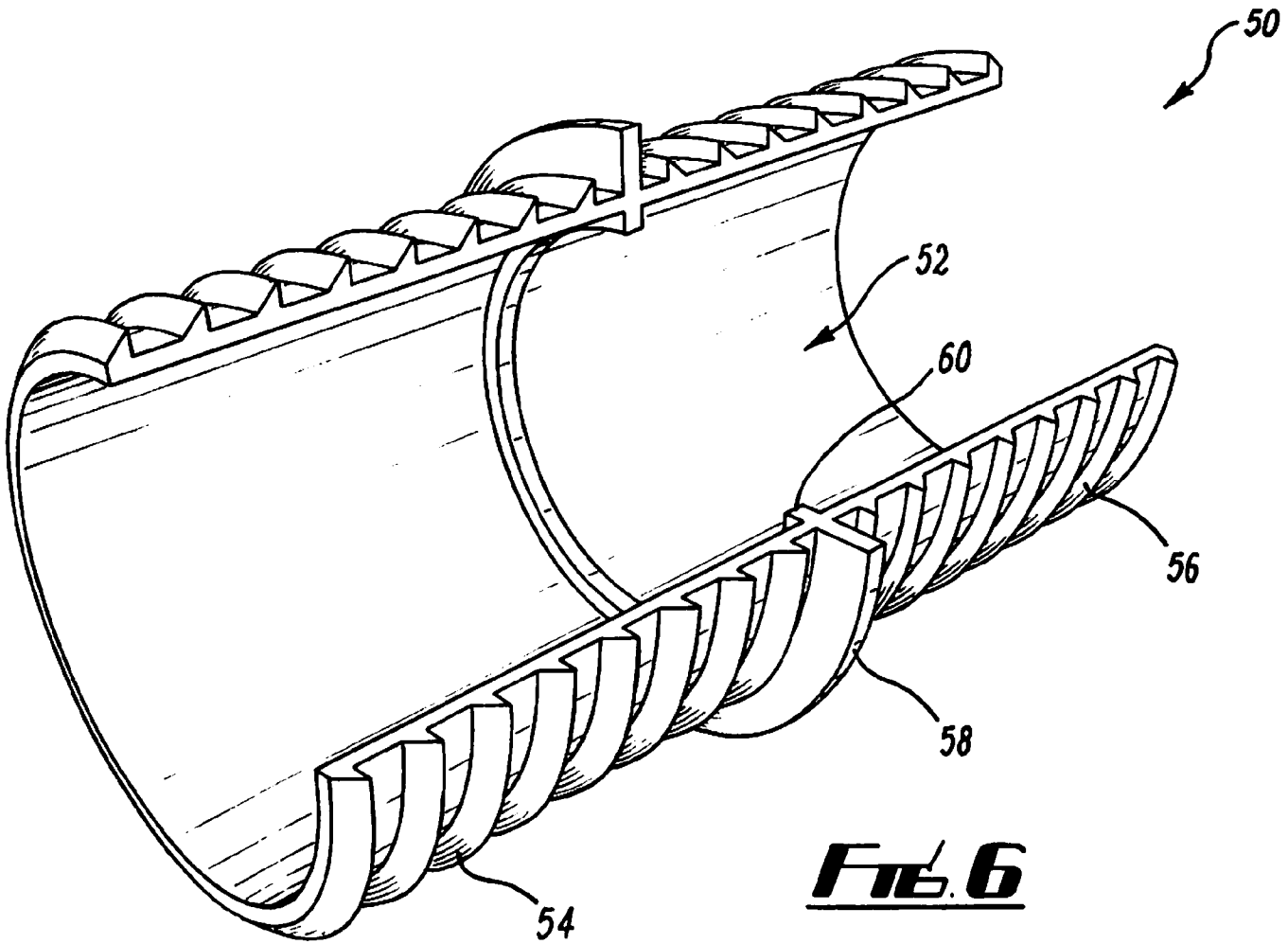
FIG. 6 provides a detailed view of a connector of the kit of parts in accordance with an embodiment of the invention.

A detailed view of a connector 50 of the kit of parts of FIGS. 1 to 4 is provided in FIG. 6. The connector is of generally cylindrical shape such that it defines a bore 52. The connector has first and second ridged profiles 54, 56 towards respective opposing ends of the connector, as described above. First 58 and second 60 flanges (which constitute arresting members) are provided on the connector 50. The first flange 58 extends radially from the external surface of the connector, i.e. in a direction away from a tubular on which an assembled kit of parts is installed. The second flange 60 extends radially into the bore 52 of the connector. The first and second flanges constrain the expansion of the swellable member as described below.

Figure 7A:
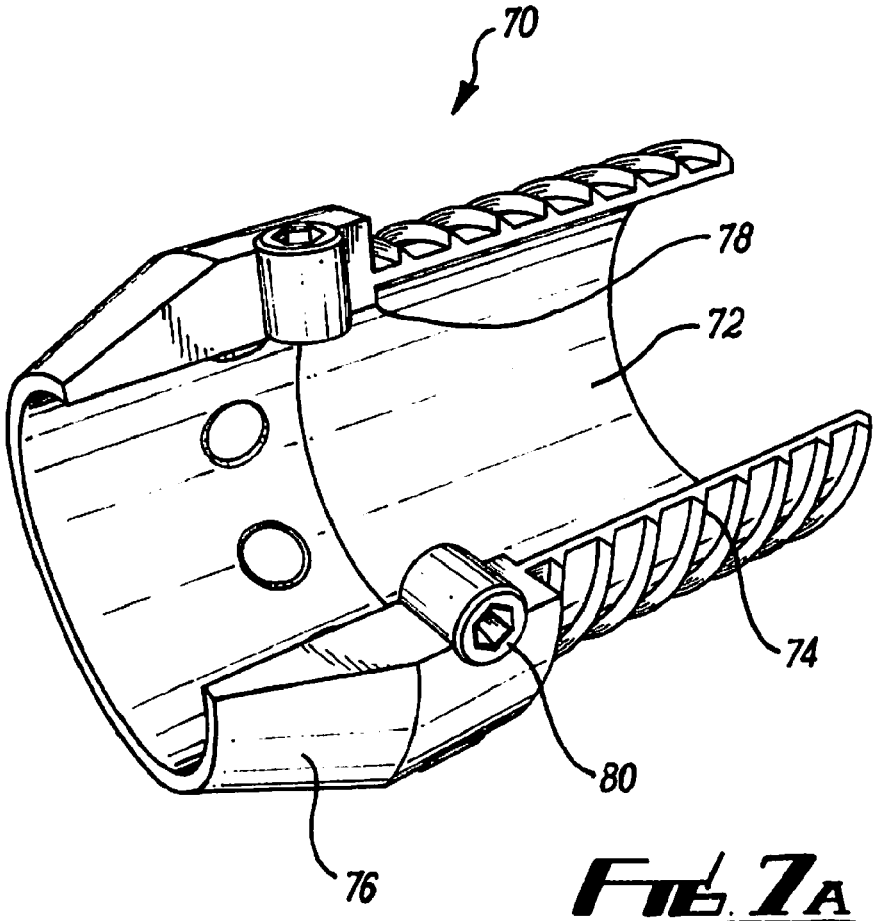
FIG. 7A provides a detailed view of an end connector of the kit of parts of FIG. 1.

A detailed view of the end connector 70 of the kit of parts of FIGS. 1 to 4 is provided in FIG. 7A. The end connector is of a generally cylindrical shape such that it defines a bore 72. A ridged profile 74 is provided towards one end of the end connector 70. The exterior surface of the opposing end of the connector is shaped to define a chamfer 76. A lip 78 is formed on an external surface and on an internal surface of the end connector. Each lip 78 defines a radially extending surface, which constrains the expansion of the swellable member as described below. The end connector 70 also has a number of bolts that threadedly engage with the end connector at locations spaced apart circumferentially around the external surface of the end connector. The bolts can be used to attach the end connector 70 to a downhole component, such as a casing.

In an alternative embodiment, the end connector 70 also comprises a bore member (not shown) that is used to change a diameter of the bore 72 to enable the end connector 70 to be configured for different diameters of tubular. The bore member supports the end connector on the tubular. In one variation, the bore member has a tapering portion, and movement of the bore member longitudinally in relation to the end connector causes the bore member to progressively reduce the bore diameter.

Figure 7B:
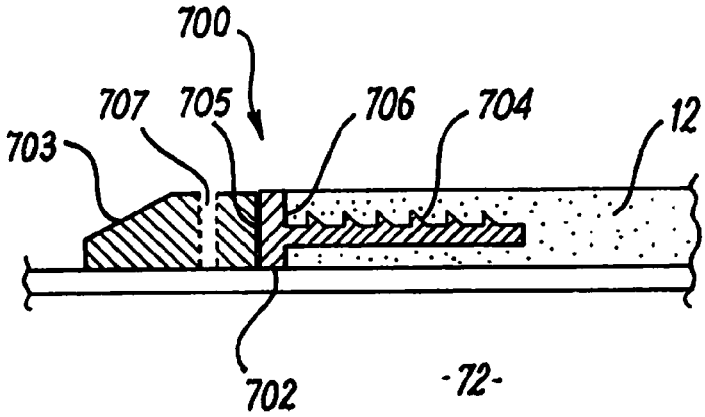
FIG. 7B provides a detailed view of part of a longitudinal section through an alternative end connector in an assembled condition.

FIG. 7B shows an end connector in accordance with an alternative embodiment of the invention. The end connector, generally depicted at 700, is similar to the end connector 70 and shown disposed on a tubular and connected to a swellable member 12. However, the end connector 701 differs in that it comprises two components: a mating portion 702 and a retaining portion 703. A ridged profile 704 is provided towards one end of the mating portion 702, which corresponds to a mating profile in a recess in the swellable member 12. The opposing end of the mating portion provides a bearing surface 705, which abuts a corresponding bearing surface 706 of the retaining portion 703. The mating portion 702 defines an enlarged bore for receiving the inner parts of the swellable member 12. The retaining portion 703 also has fixing means in the form of bolts (not shown) that threadedly engage with bores 707 at locations spaced apart circumferentially around the external surface to secure the connector to a tubular.

When used with the end connector 700, the apparatus assembled from the kit of parts will be rotatable on the tubular. The mating portion 702 is coupled to the apparatus and rotates with the apparatus, and relative to the retaining portion 703. The retaining portion 703 prevents axial movement of the apparatus.

Figure 8:
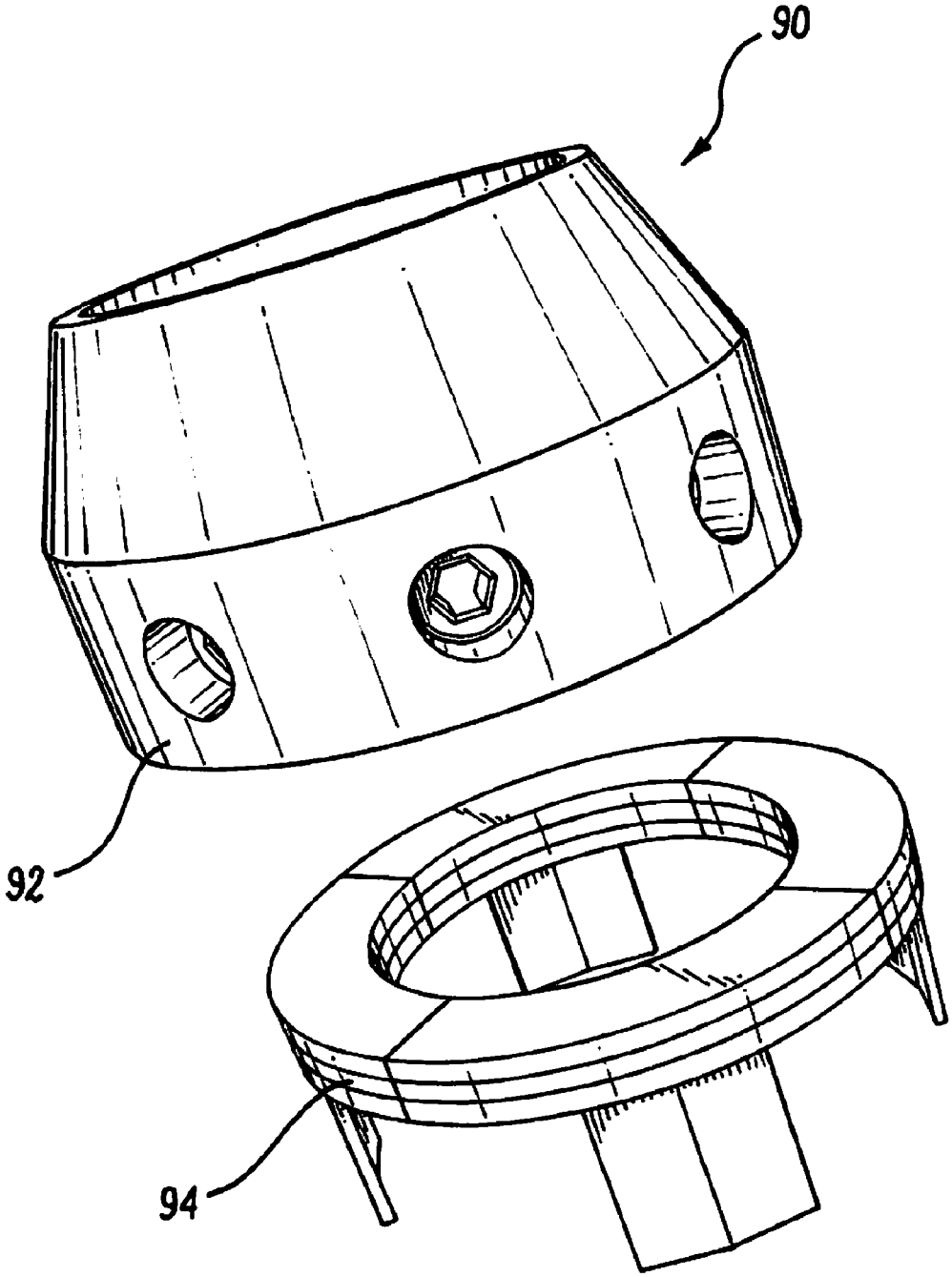
FIG. 8 provides a detailed view of an alternative end connector which forms part of an alternative embodiment of the invention.
Figure 9:
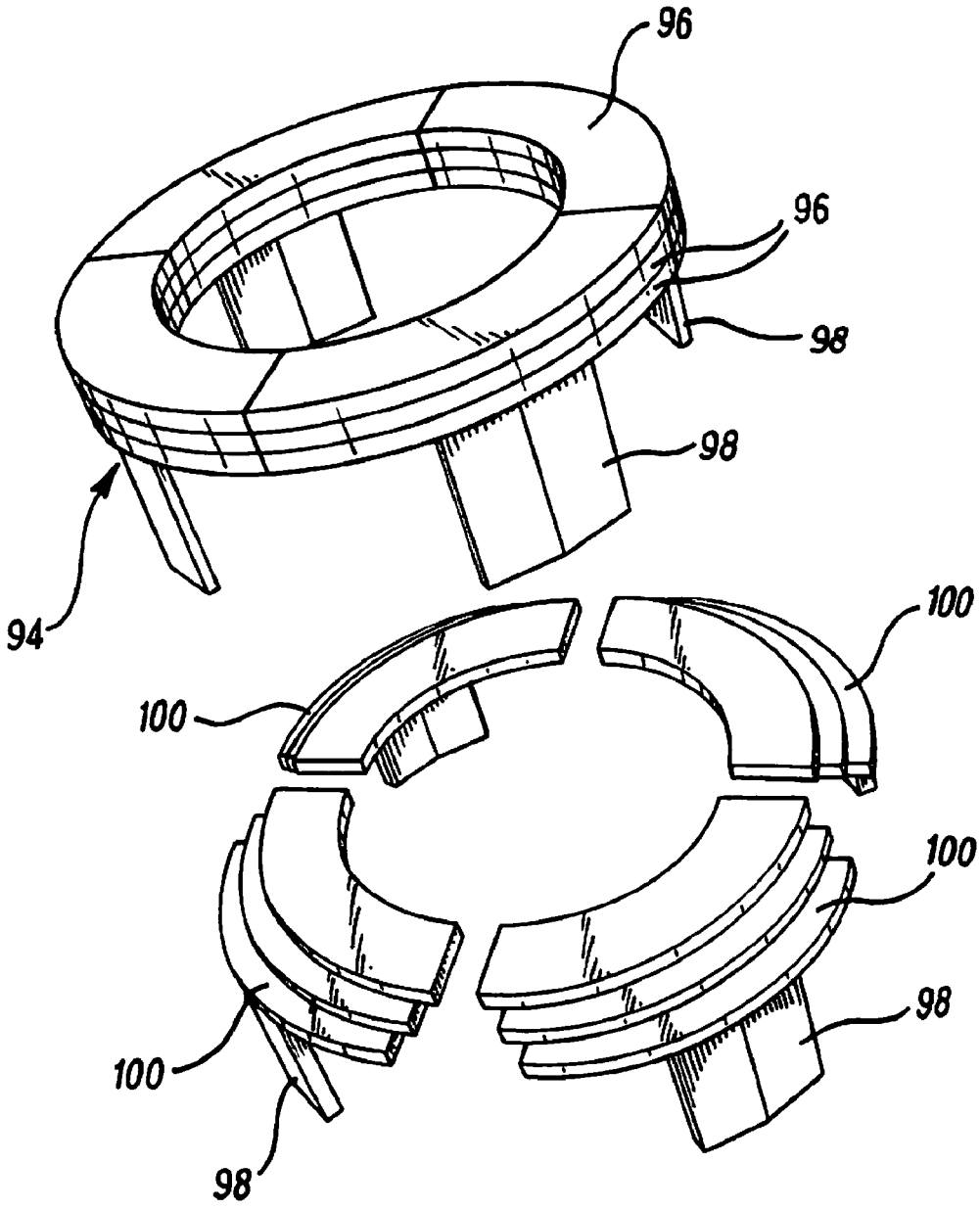
FIG. 9 provides a view of part of the embodiment of FIG. 8.

FIG. 8 provides a detailed view of another embodiment of end connector 90. The end connector 90 of the embodiment of FIG. 8 comprises a main body 92, which is as described above in relation to the embodiment of FIG. 7, and a support assembly 94. The support assembly 94 is shown in more detail in FIG. 9. The support assembly 94 is configured to abut against an external surface of a swellable member connected to the end connector 92 when the swellable member is in an unexpanded condition and to remain in contact with the external surface as the swellable member expands. More specifically, the support assembly 94 comprises a number of concentric support members 96, each of which defines a bore through which a tubular is received. One of the support members 96 has four support elements 98 which are spaced apart around and attached to the support member 96. The support elements 98 extend in a longitudinal direction such that they provide for an increase in area of contact between the support assembly and the swellable member. Each of the support elements 98 comprises four rigid support parts 100 that are configured for movement in relation to each other in a radial direction away from a tubular whereby expansion of the swellable member is accommodated.

Figure 10:
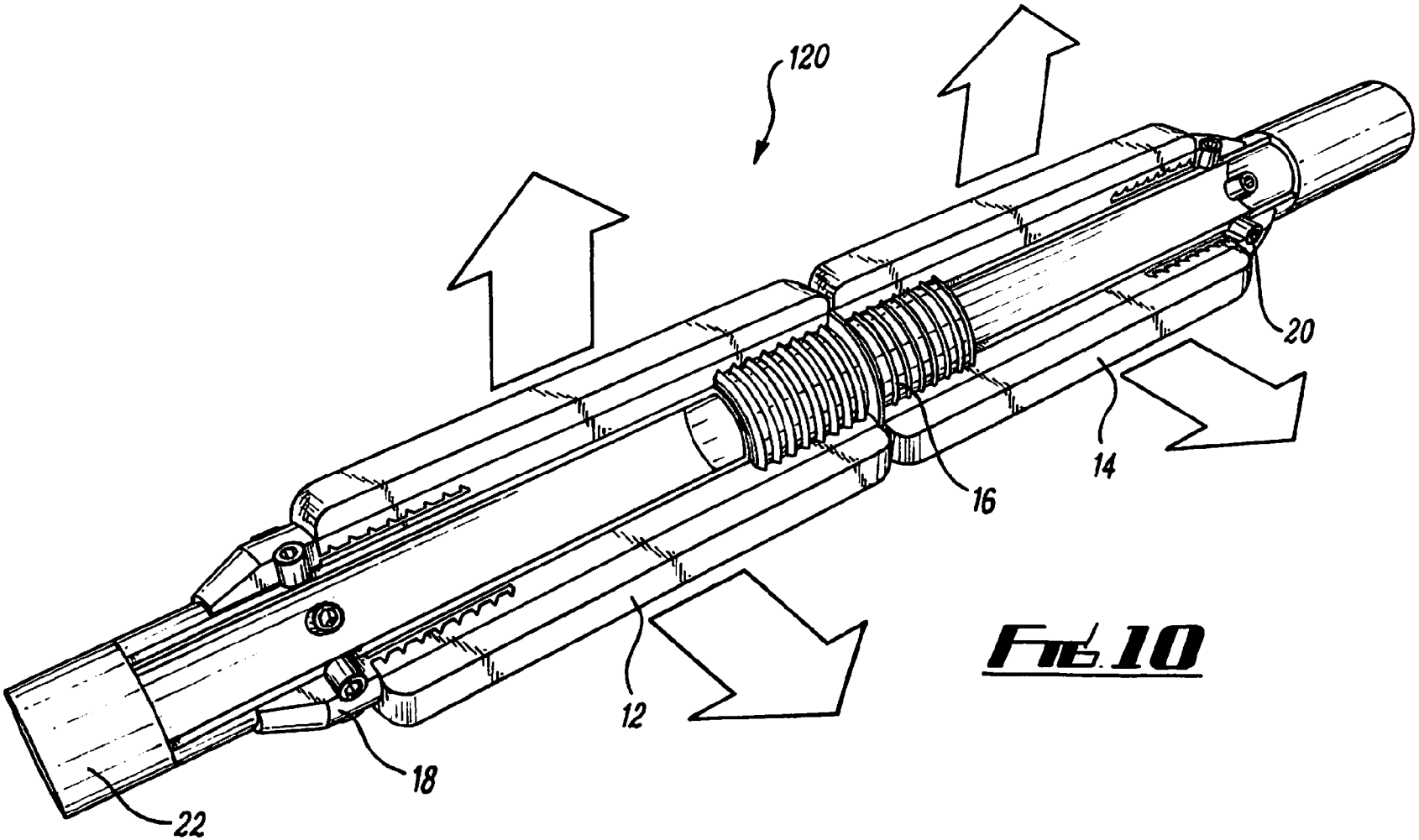
FIG. 10 shows an assembled kit of parts when the swellable member is being activated.

FIG. 10 shows an assembled kit of parts 120 in use on a tubular. The component parts of the assembled kit of parts 120 of FIG. 10 are the same as those described above with reference to FIG. 3. In use, the swellable members 12, 14 are exposed to well fluids that cause them to swell. Expansion of the swellable members is directed radially away from the tubular 22 as illustrated by the radially directed arrows. Expansion of the swellable member in a longitudinal direction is arrested by the flanges 58, 60 and lips 78 provided on the connector 16 and the end connectors 18, 20.

Figure 11:
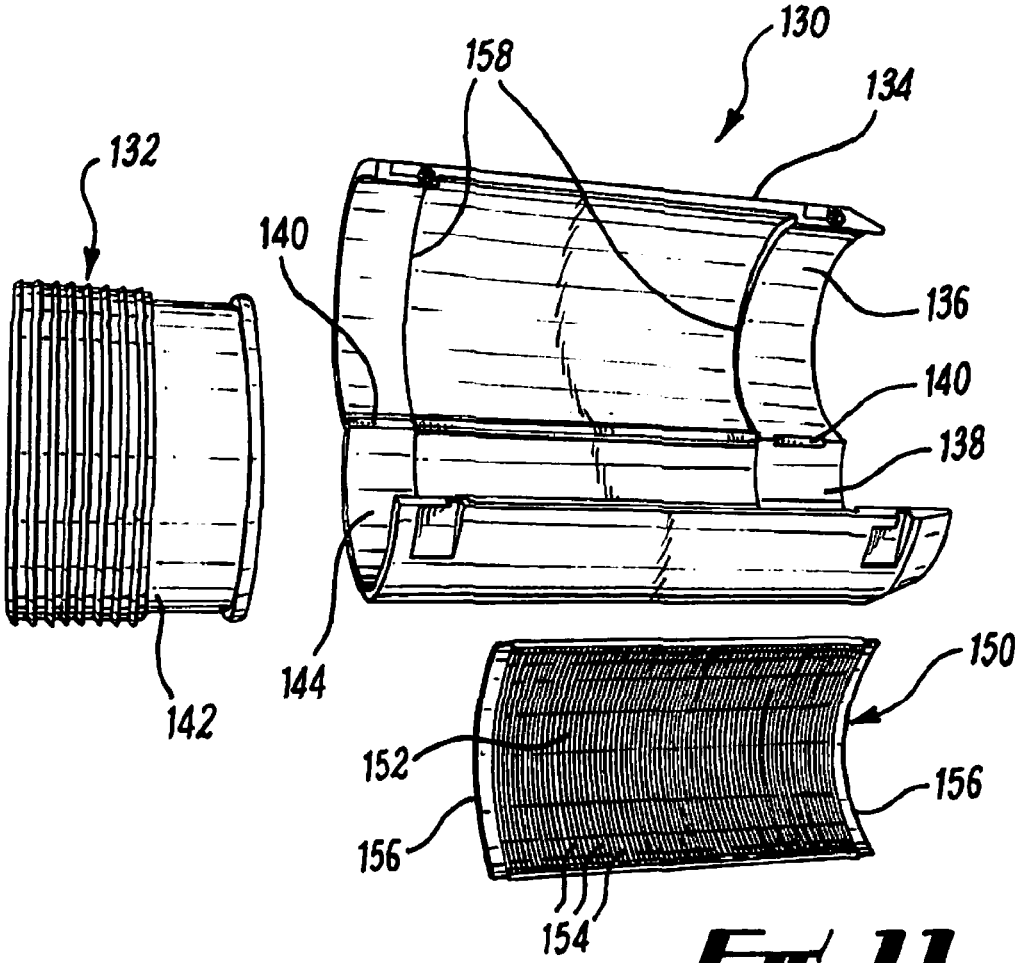
FIG. 11 shows an embodiment of the present invention, in which an alternative form of end connector is used.
Figure 12:
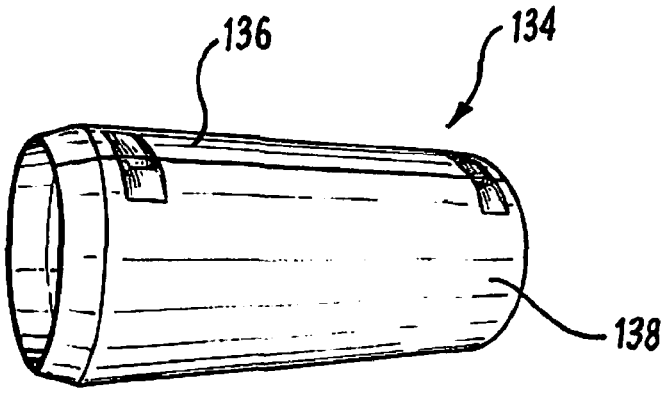
FIG. 12 shows the embodiment of FIG. 11 in its clamped condition.

FIG. 11 shows an embodiment of the present invention, in which an alternative form of end connector 130 is used. The end connector 130 has a first end connector assembly 132 configured to mate with a mating profile of the swellable member and a second end connector assembly 134 configured to be releasably attached to a tubular as described below. The second end connector assembly 134 has two end connector parts 136, 138 that are movable in relation to each other between a first disposition that provides for removal of the second end connector assembly from a tubular (as shown in FIG. 11) and a second disposition in which the second end connector assembly is clamped around a tubular. FIG. 12 shows the second end connector assembly 134 alone when it is in the second disposition. Referring again to FIG. 11, the two end connector parts 136, 138 move between the first and second dispositions by means of hinges 140 provided along respective edges. The opposing non-hinged respective edges of the two end connector parts 136, 138 are secured to each other by means of at least one of adhesive, screws, nut and bolts, or the like.

The first end connector assembly 132 and the second end connector assembly 134 have surface profiles 142, 144 that are shaped to inter-engage so that separation of the first and second end connector assemblies from each other is resisted when the second end connector assembly is clamped around a tubular.

The end connector also comprises an anti-slip assembly 150, which is configured to provide resistance to movement of the second end connector assembly on a tubular. The anti-slip assembly 150 has an anti-slip surface 152 that defines a plurality of radially extending ridges 154, which are configured to bite into the exterior surface. In use, the anti-slip assembly 150 is disposed between the second end connector assembly and the tubular. To resist separation of the anti-slip assembly and the second end connector assembly from each other, the anti-slip assembly 150 and the second end connector assembly have inter-engaging profiles 156, 158.

In an un-illustrated form of the embodiment of FIGS. 11 and 12, the second end connector assembly is shaped to provide for passage of wires along the tubular to which the second end connector assembly is attached. This is achieved by providing a longitudinally extending recess on the inner facing surface of the second end connector assembly. Thus, wires can pass between the second end connector assembly and the tubular.

In a further un-illustrated embodiment, the swellable member of the previously described embodiments is configured such that its surface defines a number of apertures (which constitutes an irregularity), each giving access to a bore that extends through the swellable member. The provision of bores increases the surface area of the swellable member that comes into contact with the fluid that causes the swellable member to expand. Thus, a rate of expansion of the swellable member is increased. Furthermore, the swellable member comprises a layer disposed over at least a part of its exterior surface. The layer is configured to control access of the at least one predetermined fluid to the exterior surface of the swellable member. Thus, the layer controls how the swellable member expands when brought into contact with the at least one predetermined fluid. More specifically, the layer is configured to present a barrier to the at least one predetermined fluid for a predetermined period of time. Thus, the layer functions as a temporary barrier. Also, the layer is configured to provide for passage of the fluid through the layer at a predetermined rate. Thus, the layer is used to reduced a rate at which the swellable member expands when in the presence of the fluid than would be the case were the layer to be absent.

Figure 13:
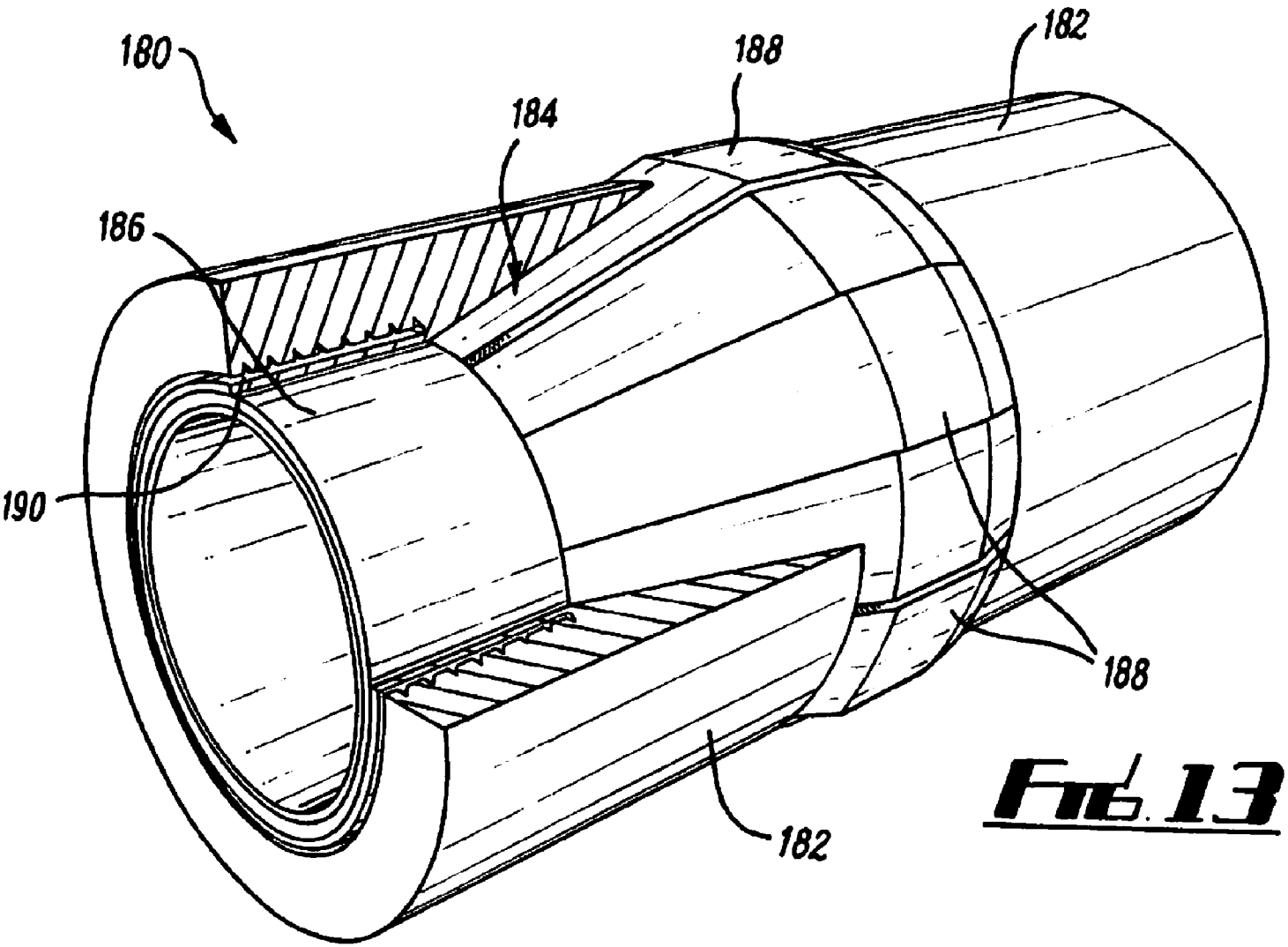
FIG. 13 shows an alternative form of a swellable member of the present invention.

FIG. 13 shows an alternative form 180 of a swellable member of the present invention. The swellable member 182 has a rigid assembly 184, which has three parts: a first collar 186, a plurality of spaced apart fingers 188 and a second collar. The first collar 186 and second collar are located within the body of the swellable member 182. The first 186 and second collars are located towards opposing ends of the swellable body and are joined by the plurality of spaced apart fingers 188. The fingers 188 are spaced apart around the circumference of the swellable member 182. The fingers 188 follow a path such that at around their mid-point they define the maximum outer diameter of the swellable member. Note that the second collar is not shown in FIG. 13. This is because FIG. 13 shows the swellable member cut away in the vicinity of the first collar 186 but not cut away in the vicinity of the second collar. The two collars and the plurality of fingers are integrally formed with each other of a suitable rigid material, such as a metal.

Each end of the swellable member defines a recess 190 having ridges to allow for push fit connection with the connector 16 described above with reference, for example, to FIG. 1.

In the above described embodiments, addition, the swellable member can be attached to the tubular on which it is being used, e.g. by means of an adhesive. Also, the connection between the connector and the swellable member can be improved by means of an adhesive.

In use, downhole apparatus comprising the swellable member of FIG. 13 is introduced downhole in a first condition before expansion of the swellable member. Thus, and as shown in FIG. 13, the rigid assembly 184 defines a maximum outer diameter of the downhole apparatus such that it provide, for example, a stand-off or stabilising function. The rigid nature of the rigid assembly 184 provides protection for the downhole apparatus. Also, the structure of the rigid assembly 184, which extends into the body of the swellable member, functions as a skeleton to moderate the effect of shear forces that would, were it not for the rigid assembly 184, be exerted in an uncontrolled manner on the swellable member. The spaced apart fingers 188 of the rigid assembly 184 can flex such that the maximum outer diameter defined by the rigid assembly 184 reduces. This allows the downhole apparatus of which the swellable member 180 forms part to pass through restrictions. When the downhole apparatus is in the desired location (e.g. where it desired to create a seal) the swellable member is exposed to the predetermined fluid as described above. The swellable member then expands such that it defines the maximum outer diameter of the downhole apparatus.

Applications of the kit of parts will now be described. The kit of parts when assembled can be used as a packer, which provides advantages over known packers. Well construction normally involves the placement of metal tubulars that are cemented into the wellbore. A metal tubular is deemed to be properly cemented in place when a predetermined volume of cement has been pumped down the inside of the tubular and fills the annular space between the tubular and the wellbore. According to known practice, well packers are then located on the inside of the cemented tubular. This means that known packers are designed to seal well defined spaces that are bounded by smooth surfaces. Such known packers are often set in a concentric manner, which means that the packer parts are configured to move uniformly in a radial direction thus allowing for little tolerance of uneven surfaces. Well packers formed from kits of parts according to the present invention can provide for improved tolerance of uneven surfaces.

The kit of parts may be assembled to provide isolation tools for various different applications. For example, in some scenarios the primary purpose of the tool may be to prevent annular flow of particles such as produced sands, and a high pressure seal may not be required, The kit of parts may thus be assembled to form a downhole apparatus consisting of a swellable member and two end connectors. Alternatively, the kit of parts may be assembled to form a downhole apparatus terminated at one end by an end connector, and connected to another tool at its opposing end by a connector 50 of the type shown in FIG. 6. In another application a packer with high pressure sealing capabilities may be formed from the kit of parts by connecting several swellable members in series. All of the above tools can be assembled from the same kit of components.

Use of the present invention can also provide benefits in meeting requirements to increase well production, efficiency and reliability and to reduce cost. Plugging (i.e. skin damage) in rock formations where cementation and perforation procedures are followed is always a concern in well construction and often the subject of much debate and investment to try and minimise its effects. The flexibility and configurability of well packers formed from the present invention can help address such problems by eliminating the cementing and perforating operations completely ensuring that formation plugging to kept to a minimum. This is because the swellable member of the present invention allows liner or tubing to be supported without cementing and thus pre-perforated tubing can be used. Furthermore, this application of the present invention eliminates the cost and time involved in cementing and perforating operations.

Use of the present invention can also provide benefits in tubular centralisation. The present invention is manufactured to be gauge with many common open hole diameters, thereby providing maximum stand-off for the swellable member and adjacent tools. The inclusion of a swellable elastomer means that the invention benefits from the integral construction of swellable member and rigid assembly that is robust and high in impact strength. Once wetted with well fluids, the swellable elastomer member allows improved running of well tubulars due to a lower frictional coefficient. This is of benefit in highly deviated wells or extended reach horizontal wells where cumulative resistive drag can prohibit the full installation of metal tubulars. Once the swellable elastomer expands, the radial swelling force can often lift pipe off the low side of horizontal boreholes, providing further centralisation.

The present invention offers the following advantages: i) The kit of parts can be adapted to and installed on any well tubular, which may be formed of plastics, composite or metal. The tubulars with which the invention can be used include: tubing, casing, sand screen, gravel pack, work strings, slick joints, coiled tubing and pump sucker rods. ii) The use of a swellable member that expands upon contact with well fluids provides for activation of the swellable member without downhole intervention. iii) A series of swellable members can be set in a non-concentric manner and irrespective of their orientation. iv) The swellable members can be set in irregular, non-circular and non-linear formations or downhole structures. v) The kit of parts can be installed in existing tubulars without the need for specialised assembly techniques or equipment. vi) The kit of parts can normally be assembled and installed without specially trained personnel. vii) Tubulars and formations of different shapes and diameters can be accommodated. viii) The downhole apparatus can be configured to control the rate of expansion of the swellable member. ix) The downhole apparatus when assembled from the kit of parts provides for integral self-centralisation when in use. x) The kit of parts can be assembled at the last minute to take account of changing specification requirements. xi) The kit of parts provides for the assembly of downhole apparatus that can have significantly reduced frictional coefficients than conventional downhole apparatus.

What is claimed is:

1. A kit of parts which, when assembled together, forms a downhole apparatus configured to be disposed on a tubular in a downhole environment, the kit of parts comprising:

a swellable member which expands upon contact with at least one predetermined fluid, the swellable member having a first mating profile towards a first end and a second mating profile towards a second, opposing end; and a connector having a mating profile configured to mate with each of the first and second mating profiles of the swellable member such that the connector can be connected to either of the first and second ends of the swellable member.

2. A kit of parts according to claim 1, in which the connector has first and second mating profiles, each of the first and second mating profiles of the connector being configured to mate with each of the first and second mating profiles of the swellable member.

3. A kit of parts according to claim 1, in which a mating profile of the connector comprises a plurality of ridges extending away from an end of the connector.

4. A kit of parts according to claim 1, in which mating profiles of the connector and the swellable member are configured for a push fit connection of the connector and the swellable member with each other.

5. A kit of parts according to claim 1, in which a mating profile of the connector comprises a threaded profile.

6. A kit of parts according to claim 1, in which the swellable member defines a mating recess, the mating profile being defined on a surface of the mating recess.

7. A kit of parts according to claim 1, in which the kit of parts further comprises:

a reinforcing arrangement configured to be disposed on a surface of the swellable member to be presented to the tubular.

8. A kit of parts according to claim 7, in which the reinforcing arrangement is embedded in the swellable member.

9. A kit of parts according to claim 1, in which the connector further comprises:

an arresting member comprising an arresting surface, wherein the arresting member is configured to arrest expansion of the swellable member and extends in a direction substantially away from a tubular on which the downhole apparatus is configured to be disposed, and wherein the arresting surface faces an end of the swellable member.

10. A kit of parts according to claim 9, in which the arresting member extends in a direction substantially towards a tubular on which the downhole apparatus is configured to be disposed and the arresting surface faces an end of the swellable member.

11. A kit of parts according to claim 1, in which the kit of parts further comprises a second swellable member.

12. A kit of parts according to claim 11, in which the second swellable member has a first mating profile towards a first opposing end and a second mating profile towards a second, opposing end.

13. A kit of parts according to claim 12, in which the first and second mating profiles of the second swellable member are configured to mate with a mating profile of the connector.

14. A kit of parts according to claim 1, in which the kit of parts further comprises an end connector configured to mate with a mating profile of the swellable member.

15. A kit of parts according to claim 14, in which the end connector comprises a mating portion configured to mate with the swellable member and a retaining portion configured to be attached to a tubular.

16. A kit of parts according to claim 15 in which the mating portion and the retaining portion are configured to be rotatable with respect to one another.

17. A kit of parts according to claim 14, in which the end connector comprises:

a first end connector assembly configured to mate with a mating profile of the swellable member; and a second end connector assembly configured to be releasably attached to a tubular, wherein the first and second end connector assemblies are configured to be releasably attached to each other.

18. A kit of parts according to claim 17, wherein the second end connector assembly is shaped to provide for passage of at least one elongate body, such as a wire or small diameter pipe, along the tubular to which the second end connector assembly is attached such that the at least one elongate body passes between the second end connector assembly and the tubular.

19. A kit of parts according to claim 14, in which the end connector has an anti-slip surface configured to resist movement across an exterior surface of the tubular.

20. A kit of parts according to claim 14, in which the end connector comprises:

an end arresting member comprising an arresting surface, wherein the arresting member is configured to arrest expansion of the swellable member and extends in a direction substantially away from a tubular on which the downhole apparatus is configured to be disposed, and wherein the arresting surface faces an end of the swellable member.

21. A kit of parts according to claim 20, wherein the end arresting member extends in a direction substantially towards a tubular on which the downhole apparatus is configured to be disposed, and wherein the arresting surface faces an end of the swellable member.

22. A kit of parts according to claim 1, in which the kit of parts further comprises:

a support apparatus configured to abut against a surface of the swellable member before and during expansion of the swellable member, wherein the surface against which the supporting apparatus abuts being presented, in use, towards the tubular.

23. A method of assembling a downhole apparatus, the method comprising:

connecting a connector to a swellable member to form the downhole apparatus by mating a mating profile of the connector with one of first and second mating profiles of the swellable member, wherein the mating profile of the connector is configured to mate with each of the first and second mating profiles, and wherein the first mating profile is configured to face towards a first end of the connector and the second mating profile is configured to face towards a second, opposing end of the connector, and wherein the swellable member is configured to expand upon contact with at least one predetermined fluid, and wherein the downhole apparatus is configured to be disposed on a tubular in a downhole environment.

24. A kit of parts which, when assembled together, forms a wellbore packer, the kit of parts comprising:

a plurality of swellable members that expand upon contact with at least one pre-determined fluid, wherein each swellable member has a first mating profile towards a first end and a second mating profile towards a second, opposing end; and a connector having a mating profile configured to mate with first and second mating profiles of the swellable member such that the connector can be connected to each of the first and second swellable members to assemble a wellbore packer.

* * * * *